United States Patent [19]

Kaneyasu et al.

[11] Patent Number: 4,955,346

[45] Date of Patent: Sep. 11, 1990

[54] THROTTLE CONTROL APPARATUS OF INTERNAL COMBUSTION ENGINE

[75] Inventors: Masayoshi Kaneyasu, Hitachi; Nobuo Kurihara, Hitachioota, both of Japan

[73] Assignee: Hitachi, Ltd., Tokyo, Japan

[21] Appl. No.: 360,237

[22] Filed: Jun. 1, 1989

[30] Foreign Application Priority Data

Jun. 3, 1988 [JP] Japan ..... 63-135605

[51] Int. Cl.[5] ..... F02D 11/10

[52] U.S. Cl. ..... 123/399; 123/361

[58] Field of Search ..... 123/361, 399

[56] References Cited

U.S. PATENT DOCUMENTS

| | | | |
|---|---|---|---|
| 4,418,673 | 12/1983 | Tominari et al. | 123/478 |
| 4,569,320 | 2/1986 | Collonia | 123/399 |
| 4,592,322 | 6/1986 | Murakami et al. | 123/399 X |
| 4,640,243 | 2/1987 | Abo et al. | 123/399 |
| 4,671,235 | 6/1987 | Hosaka | 123/399 X |

FOREIGN PATENT DOCUMENTS

| | | |
|---|---|---|
| 239095 | 9/1987 | European Pat. Off. . |
| 200345 | 9/1986 | Japan . |

*Primary Examiner*—Tony M. Argenbright

*Attorney, Agent, or Firm*—Antonelli, Terry, Stout & Kraus

[57] ABSTRACT

A throttle control apparatus of an internal combustion engine comprises an accelerator opening detector, an engine revolution speed detector, a throttle actuator and a control unit constructed so as to generate and output, to the throttle actuator, a throttle driving signal for operating the throttle valve according to a throttle opening pattern determined on the basis of an accelerator opening, an accelerator opening speed and engine revolution speed, the throttle opening pattern includes a first target opening to which throttle valve is opened upon a rapid accelerator operation and which is determined according to an accelerator depression quantity, an accelerator depression speed and an engine revolution speed, a second target opening to which said throttle valve is opened after a predetermined time lapsed from the starting of the rapid accelerator depression and which is determined according to an accelerator depression quantity, an accelerator depression speed and an engine revolution speed.

12 Claims, 7 Drawing Sheets

THROTTLE CONTROL APPARATUS OF INTERNAL COMBUSTION ENGINE

BACKGROUND OF THE INVENTION

The present invention relates to a throttle control apparatus of an internal combustion engine such as for automobiles and, more particularly, to a throttle control apparatus of an internal combustion engine, which controls throttle opening, based on a throttle opening pattern determined according to the amount and speed of actuation, and engine rotational speed.

An example of a conventional throttle valve control apparatus of an internal combustion engine, such as for automobiles, is disclosed in European Patent Publication No. 0 239 095, wherein throttle opening and an ignition timing are determined on the basis of a supply fuel quantity calculated from an accelerator operation quantity and a transmission change position signal, an operation variable signal such as the number of revolutions of the engine, and the air-fuel ratio.

Another example of a conventional throttle control apparatus is disclosed in Japanese Patent Laid-Open No. 61-200345/1986, wherein the control gain of a throttle control device is changed in response to an engine operation condition, such as suction pressure detected by an engine operation condition detector.

The conventional throttle valve control apparatus is constructed in such a manner as to primarily detect a throttle opening value corresponding to an accelerator operation quantity and to statically control a throttle on the basis of the calculation value, but does not take into consideration how to reflect accurately and rapidly the intention of a driver on the engine operation so as to follow up an abrupt change of an engine state quantity occurring due to the drastic operation of an accelerator. The prior art technique does not pay sufficient consideration, either, to prior control and synchronous control for a transmission delay due to an engine structure and a transmission mechanism such as the time required for the change of a supply air quantity or a fuel quantity to reach a cylinder or the delay time in the change in behaviours resulting from operation of complicated mechanisms. In other words, the prior art technique involves the problem that it cannot restrict the droop and slowness occurring when the accelerator operation changes abruptly and the vibration of a car body in the longitudinal direction.

SUMMARY OF THE INVENTION

An object of the present invention is to provide a throttle control apparatus of an internal combustion engine which can eliminate longitudinal vibration of the automobile which gives offensive feel to the driver.

Another object of the present invention is to provide a throttle control apparatus of an internal combustion engine which can cause an automobile to respond smoothly and rapidly to a rapid change in an accelerator operation and can eliminate longitudinal vibration of the automobile which gives offensive feel to the driver.

The object described above can be accomplished by a throttle control apparatus of an internal combustion engine according to the present invention, which throttle control apparatus comprises an accelerator opening detector for detecting accelerator depression, an engine revolution speed detector, actuating means for actuating a throttle valve, a control unit for outputting a driving signal for driving the actuating means, and characterized in that said control unit is constructed to generate a throttle drive signal executing a throttle opening pattern determined on the basis of an accelerator opening which is represented by an accelerator depression amount, and an accelerator depression speed and an engine revolution speed, and output the throttle drive signal to the throttle actuating means to operate the throttle valve.

An example of the throttle opening pattern is such that the throttle valve is opened, for a short period of time, to a throttle opening more than a throttle opening determined according to an accelerator depression quantity after an acceleration operation at a speed more than a predetermined one for accelerating the automobile, thereby to eliminate longitudinal vibration due to the acceleration of the automobile.

Another example of the throttle opening pattern includes a first target opening to which the throttle valve is opened upon a rapid accelerator operation and which is determined according to an accelerator depression quantity, an accelerator depression speed and an engine revolution speed, a second target opening to which said throttle valve is opened after a predetermined time has lapsed from the start of the rapid accelerator depression and which is determined according to an accelerator depression quantity, an accelerator depression speed and an engine revolution speed.

The throttle control apparatus further includes a construction wherein there are provided supply fuel quantity regulation means and ignition timing regulation means capable of regulating supply fuel quantity so as to provide a desired air-fuel ratio by estimating the air quantity supplied to the engine on the basis of the throttle opening pattern determined by the control unit described above and an ignition timing providing desired engine output efficiency for the air-fuel ratio in the interlocking arrangement with the opening/closing of the throttle valve, respectively.

The throttle control apparatus of the internal combustion engine according to the present invention operates the throttle valve in a mode different from the mode in which the throttle valve is directly operated according to movement of the accelerator.

The intension of the driver is reflected in the accelerator depression quantity representing a desired car speed after settling and the accelerator depression speed representing the requirement for the speed of the change of the car speed, that is, quick response. Particularly when quick response is insufficient, this insufficiency gives strong dissatisfaction to the driver but a transmission delay occurs inevitably because an intake system in which air reaches the cylinder is a secondary delay system. Accordingly, the air-fuel mixture supplied to the cylinder changes only in a lamp-like form so that the response of the engine lacks instantaneousness. In order to satisfy the requirement of the driver for quick response, the shortest time control must be made so as to transmit the change of the air-fuel mixture supply quantity as rapidly as possible to the cylinder, and a calculation procedure for modifying the throttle opening pattern from the accelerator operation speed thereby detected is executed to accelerate the air-fuel mixture in accordance with the accelerator operation speed and to transmit it to the cylinder, thereby accomplishing the shortest time control. Accordingly, it is possible to provide the car body with sufficient quick response without generating forward and backward acceleration of the car body, that is, surging in longitudinal acceleration of the car body.

DESCRIPTION OF THE INVENTION

Hereinafter, embodiments of the present invention will be described with reference to the drawings.

Figure 1:
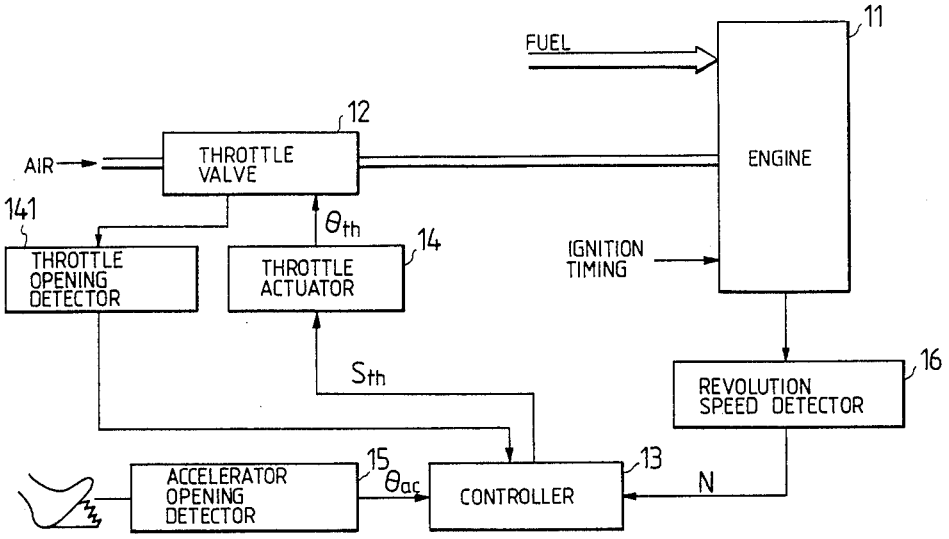
FIG. 1 is a structural block diagram showing an embodiment of a throttle control apparatus of an internal combustion engine in accordance with the present invention.

FIG. 1 is a structural block diagram of engine control using throttle valve control and shows an embodiment of the throttle control apparatus of an internal combustion engine in accordance with the present invention.

In FIG. 1, an internal combustion engine 11 is provided with an intake passage for introducing air into the engine 11. On the intake passage, a throttle valve 12 is mounted for adjusting air flow. A controller 13 is provided for controlling the throttle valve 12 through a throttle actuator 14, which comprises, for example, a stepping motor or DC motor for driving the throttle valve, and a driver for operating the motor. The control unit 13 receives an accelerator opening signal $\theta_{ac}$ from an accelerator opening detector 15 and a r.p.m. signal N from a revolution speed detector 16. When a DC motor is employed in the throttle actuator 14, a throttle opening detector 141 is provided to detect an opening of the throttle valve 12 and the control unit uses a throttle opening signal from the throttle opening detector 141 to control the throttle valve 12 so that a real throttle opening becomes a target throttle opening. If a stepping motor is used for the throttle actuator 14, the throttle opening detector 141 is omitted. The engine 11 is operated on the basis of operation parameters, such as a fuel quantity, a supply air quantity, an ignition timing, and the like. The throttle valve 12 is disposed in an intake system and the supply air quantity can be adjusted thereby. This throttle valve 12 is driven by the throttle actuator 14 which is controlled by a throttle driving signal $S_{th}$ from the control unit 13. The accelerator opening $\theta_{ac}$, that is, accelerator depression or stepping quantity (degree) obtained from the accelerator opening detector 15 and the r.p.m. speed N of the engine from the engine revolution speed detector 16 are supplied to the control unit 13. The control unit 13 generates the throttle driving signal $S_{th}$ on the basis of the accelerator opening $\theta_{ac}$ and the r.p.m. speed N of the engine. In this case, the control unit 13 determines a pattern of throttle opening $\theta_{th}$ so that the degree of opening of the throttle valve can be increased or decreased not only by the acceleration depression quantity but also by the accelerator depression speed in order to satisfy the requirement of the driver recognized from the accelerator operation, calculates the throttle driving signal $S_{th}$ for accomplishing this opening pattern and instructs it to the throttle actuator 14. The throttle valve 12 is opened and closed in accordance with the pattern of throttle opening $\theta_{th}$ determined by the control unit 13. Accordingly, the car body does not generate vibrational acceleration in the longitudinal direction, that is, forward backward acceleration, and can quickly respond to the accelerator operation.

Figure 2B:
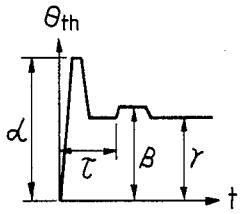
FIG. 2*b* is an illustration of an example of a throttle opening pattern.
Figure 2A:
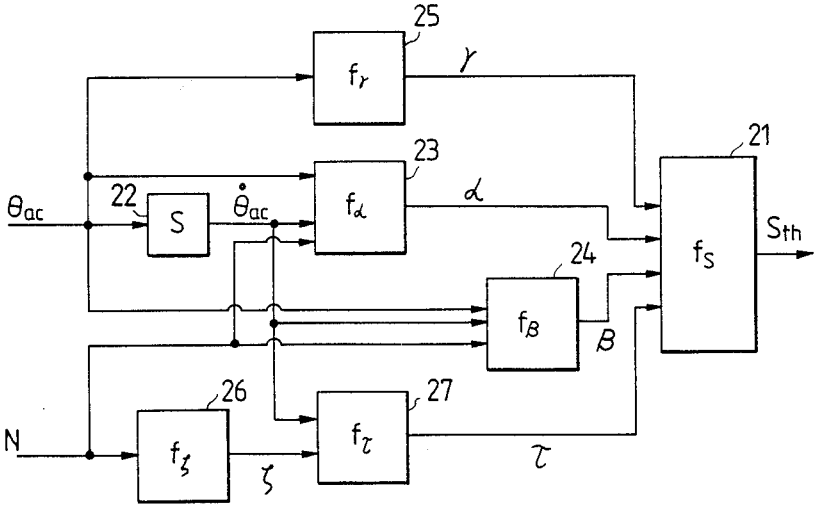
FIG. 2*a* is a functional block diagram of the calculation process of a throttle driving signal of a controller shown in FIG. 1.

FIG. 2*a* is a functional block diagram showing an embodiment of the calculation process of the throttle driving signal $S_{th}$ in the control unit 13 shown in FIG. 1 and FIG. 2*b* is a diagram showing an embodiment (design example) of a pattern of the throttle opening $\theta_{th}$. In FIGS. 2*a* and 2*b*, the throttle driving signal $S_{th}$ is calculated from four variables, i.e., target openings $\alpha$, $\beta$ and $\gamma$ and a time $\tau$, by a calculation unit 21 of a function $f_s$. Here, the first target opening $\alpha$ is a target opening for the acceleration (air) intake to improve quick response and is calculated from the accelerator opening $\theta_{ac}$ of FIG. 2*a*, an accelerator opening speed or accelerator depression speed $\theta_{ac}$ obtained by differentiating this $\theta_{ac}$ with respect to time by a differential unit 22 and the number of revolutions (r.p.m.) N of the engine by a calculation unit 23 of the function $f\alpha$ of the following equation:

$$\begin{aligned} \alpha &= f\alpha(\dot{\theta}_{ac}, \theta_{ac}, N) \\ &= k_1\left\{1 + k_2 \cdot \left|\frac{\dot{\theta}_{ac}}{A}\right|^{m1} \cdot N^{m2}\right\}\theta_{ac} \end{aligned} \tag{1}$$

wherein $k_1$, $k_2$, $m_1$, $m_2$ and A are constants, and $|\ |$ is a Gauss sign $[|x|=0\ (0 \leqq x < 1),\ n\ \{x=n+d\ (n{:}\text{integer},\ 0 \leqq d < 1)\}]$ An example of the first target opening $\alpha$ is given as follows:

$$\alpha = 2\left\{1 + 0.133 \cdot \left|\frac{\dot{\theta}_{ac}}{25}\right|^{0.85} \cdot N^{-0.03}\right\}\theta_{ac} \tag{1'}$$

wherein N:r.p.m., $\theta_{ac}$:deg., $\dot{\theta}_{ac}$:deg/sec. In this case, A is given as 25 deg/sec, which means that the throttle control apparatus causes the throttle valve 12 to operate so as to effect quick response when the accelerator is depressed at an opening rate more than 25 deg/sec. and the throttle valve 12 is operated according to the accelerator depression rate when the accelerator is operated at a rate of 25 deg/sec or less because in this case, a relationship between the throttle valve opening and the accelerator opening is set such that when the accelerator is depressed 45°, the throttle valve is opened 90°, that is, a throttle opening$=2\theta_{ac}$. The relationship, which is expressed as $k_1$ in the equation (1), is not fixed as $k_1=2$, and any other value can be taken if desired.

The second target opening $\beta$ is a target opening at the time of asynchronous intake directed to reduce the vibration of the longitudinal acceleration and is calculated from the accelerator opening $\theta_{ac}$, $\dot{\theta}_{ac}$ described above and from the number of revolution N by a calculation unit 24 of a function $f_{62}$ in accordance with the following equation:

$$\beta = f_\beta(\dot{\theta}_{ac}, \theta_{ac}, N) = k_1\left\{1 + k_3 \cdot \left|\frac{\dot{\theta}_{ac}}{B}\right|^{m3} \cdot N^{m2}\right\}\theta_{ac} \quad (2)$$

where $k_3$, $m_3$ and B are constants.

An example of the second target opening $\beta$ is given as follows:

$$\beta = 2\left\{1 + 0.033 \cdot \left|\frac{\dot{\theta}_{ac}}{5}\right|^{0.55} \cdot N^{-0.05}\right\}\theta_{ac} \quad (2)'$$

In this case, the throttle control apparatus causes the throttle valve to take an opening more than that taken according to the accelerator opening when the accelerator opening rate is more than 5 deg/sec, and $\beta=2\theta_{ac}$ when the accelerator opening rate is 5 deg/sec or less. Namely, in the above example, an automobile causes forward-backward acceleration when the accelerator is operated at rate of more than 5 deg/sec without controlling the throttle valve according to this embodiment.

Other value of B can be used for 5 according to kind, size of engine, automobile etc.

The third target opening $\gamma$ is a target opening for determining the car speed at the time of settling and is calculated from the accelerator opening $\theta_{ac}$ by a calculation unit 25 of the function $f_\gamma$ of the following equation:

$$\gamma = f_\gamma(\theta_{ac}) = k_1 \cdot \theta_{ac} \quad (3)$$

An example of the third target opening $\gamma$ is $2\cdot\theta_{ac}$ (deg.).

The fourth target value $\tau$ is the time at which asynchronous intake which is air intake caused asynchronously with an accelerator operation is started and it is measured simultaneously with the start of the acceleration air intake. First of all, surging period change rate or ratio $\xi$ when the longitudinal acceleration oscillates is calculated from the number of revolutions N (r.p.m.) by a calculation unit 26 of a function $f_\xi$ of the following equation and the time $\xi$ is then calculated from the surging period change ratio $\xi$ and the accelerator opening $\theta_{ac}$ by a calculation unit 27 of a function $f_\xi$ of the following equation:

$$\zeta = f_\zeta(N) = k_4 \cdot N^{m4} \quad (4)$$

-continued $$\tau = f_\tau(\dot{\theta}_{ac}, \zeta) = k_5 \cdot \zeta \cdot (\theta_{ac})^{m5} \quad (5)$$

where $k_4$, $k_5$, $m_4$ and $m_5$ are constants.

A concrete example of the equations (4) and (5) are given as follows:

$$\zeta = 16.3 \cdot N^{-0.42} \quad (4)'$$

$$\tau = 84 \cdot \zeta \cdot \left(\frac{\dot{\theta}_{ac}}{25}\right)^{0.2} \quad (5)'$$

The time $\tau$ is a time period from a time at which the accelerator is depressed to accelerate the automobile. After the lapse of the time $\tau$, air intake is effected by throttle valve to reach the second target opening $\beta$ whereby surging in the forward and backward acceleration is reduced even if the automobile is sufficiently accelerated.

In this manner, in accordance with this embodiment, the throttle opening pattern can be designed by the simple parameters.

Figure 3A:
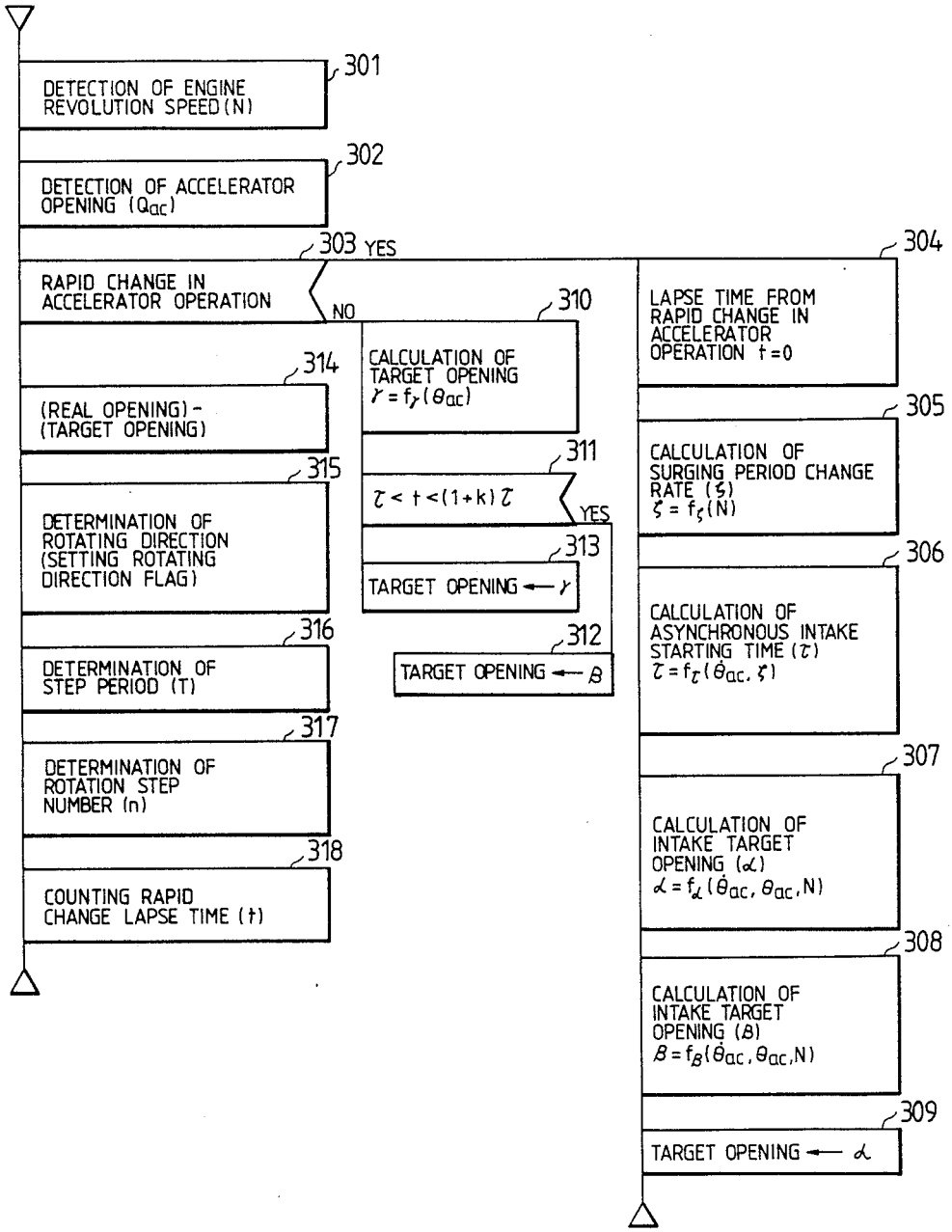
FIGS. 3*a* and 3*b* are problem analysis diagrams showing an example of the throttle driving control algorithm of the controller of FIG. 1.
Figure 3B:
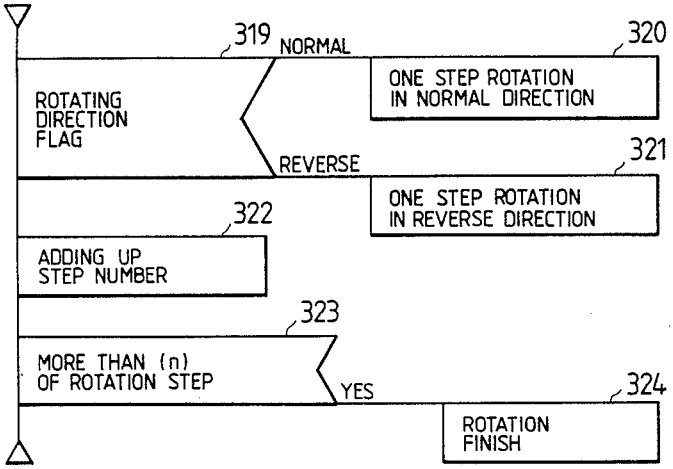

FIGS. 3*a* and 3*b* are problem analysis diagrams (PAD) showing an embodiment of the throttle driving (control) algorithm in the control unit 13 shown in FIG. 1. FIG. 3*a* shows the task which is executed in a period believed sufficient to monitor the change of the accelerator operation such as every 20 msec and FIG. 3*b* shows the task which is executed in one step unit when the throttle valve 12 is driven.

First, in the task shown in FIG. 3*a*, the number of revolutions N of the engine is detected (processing 301) and the accelerator opening $\theta_{ac}$ is detected (processing 302). Then, the rapid change of the accelerator operation is judged (processing 303), and the passage of time t from the rapid change of the accelerator operation when such change occurs is set to 0 (processing 304) and the surging period change ratio $\xi$ is calculated in accordance with the equation (4') $\xi=f_\xi(N)$, for example, when the longitudinal direction acceleration oscillates (processing 305). The time $\tau$ at which asynchronous air intake is started is calculated in accordance with the equation (5'), i.e., $\tau=f_\tau$ (processing 306) and the target opening $\alpha$ when the acceleration air intake is executed is calculated in accordance with the equation (1'), i.e. $\alpha=f_\alpha(\dot{\theta}_{ac}, \theta_{ac}N)$ (processing 307) and the target opening $\beta$ when the asynchronous air intake is executed is calculated in accordance with $\beta=f_{62}(\dot{\theta}_{ac}, \theta_{ac}, N)$ of the equation (2) (processing 308). Then, $\gamma$ is substituted by the target opening (processing 309). If there is not abrupt change in the accelerator operation in processing 303, the target opening $\gamma$ of FIGS. 2(*a*), (*b*) is calculated by $\gamma=f_\gamma(\theta_{ac})$ of the equation (3) (processing 310) and the judgment of the next inequality is carried out:

$$\tau < t < (1+k)\tau \quad (6)$$

where k is a constant for determining the duration time of the asynchronous air intake, for example, 0.3.

Here, if the lapse time t satisfies the inequality (6) under the state where the lapse time t has some meaning immediately after the rapid change of the accelerator operation, the $\beta$ value is put to the target opening (processing 312) and if the inequality (6) is not satisfied, the throttle opening is put to the opening $\gamma$ (processing 313). The difference between the set target opening and the actual throttle opening (real opening) if the DC motor is used in the throttle actuator 14 is calculated (processing 314) and the rotating direction of the step motor for rotating the throttle valve 12 is determined and the rotating direction flag is set (processing 315). The period T in which the motor is driven step-wise in accordance with the difference of processing 314 described above is determined (processing 316) and similarly, the number of rotation steps n is determined (processing 317). Finally, the rapid change lapse time t is counted and the task is completed (processing 318).

Next, in the task shown in FIG. 3*b*, this task is effected in every step period T described above when the motor is rotated. The normal or reverse rotation of the rotating direction flag is judged (processing 319) and if the rotating direction is normal, the motor is rotated by one step in the normal direction (processing 320). If it is reverse, the motor is rotated in reverse by one step (processing 321) and the step number of rotations is added up (processing 322). Whether or not this value is above the rotation step number n is judged (processing 323) and if it is above the step number n, the motor rotation is completed (processing 324). In this manner this embodiment can reliably execute the throttle driving control for regulating the throttle opening $\theta_{th}$ in accordance with the accelerator operation speed.

Figure 4:
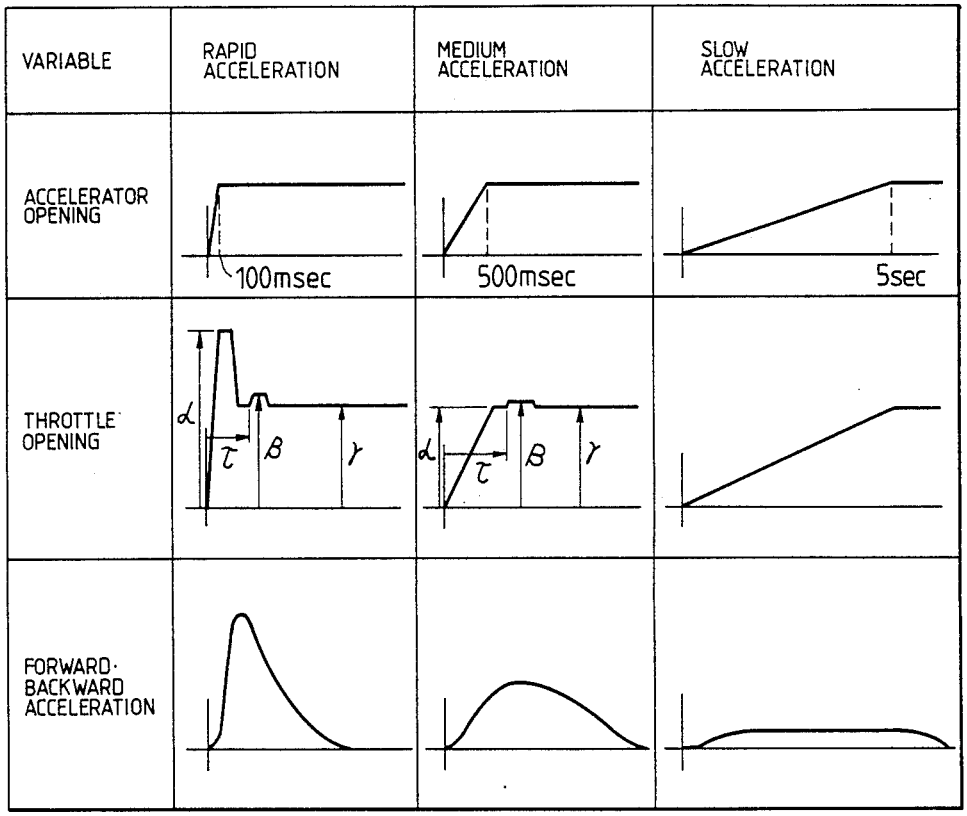
FIG. 4 is a chart diagram showing operation examples when the accelerator operation speed in FIG. 1 is different.

FIG. 4 is a flow chart showing modes of the throttle driving patterns when the accelerator is operated at various speeds and examples of changes in forward and backward acceleration of the automobile. FIG. 4 shows the cases where the time required for the accelerator opening $\theta_{ac}$ to reach the final value from the initial value, that is, the time necessary for the revolution speed N to rise from 800 r.p.m. to 1,000 r.p.m., is 100 msec, 500 msec and 5 sec, respectively, as the examples of the accelerator operation speed in the cases of rapid acceleration, medium acceleration and slow acceleration.

The throttle opening $\theta_{th}$ in the case of slow acceleration increases substantially in the same way as the accelerator opening $\theta_{ac}$, that is, $\theta_{th}$ is $2\theta_{ac}$ in the previously mentioned case and acceleration of a small scale occurs continuously as the longitudinal acceleration of the automobile.

In contrast, the throttle opening $\theta_{th}$ in the case of the rapid acceleration opens rapidly to the acceleration intake target opening $\alpha$ simultaneously with the start of the accelerator operation and is closed to the set target opening $\gamma$ by recognizing that the accelerator operation becomes constant. The opening and closing operation is effected at a full speed of the motor employed in the throttle actuator, for example. It opens to the asynchronous intake target opening $\beta$ at the point of time where the asynchronous intake start time $\tau$ has elapsed, is kept opened for the time $k_\tau$ of the formula (6) and again closed to the set target opening $\gamma$.

In this manner, the longitudinal direction acceleration rises extremely rapidly with the change of the throttle opening $\theta_{th}$, reaches the high peak value and falls smoothly without causing the longitudinal direction vibration to the automobile. Accordingly, there can be obtained the effect that the acceleration operation can be finished within a short time.

As to the throttle opening $\theta_{th}$ in the case of medium acceleration, the acceleration intake target opening $\alpha$ is similar to the set target opening $\gamma$ because the accelerator operation is not drastic and since the rotating speed N does not rise rapidly, either, the asynchronous intake start time $\tau$, too, becomes longer than that of the rapid acceleration, and the asynchronous intake target opening $\beta$ is kept relatively long with a small opening. Since the throttle opening $\theta_{th}$ changes in this manner, the longitudinal direction acceleration rises smoothly and since no peak develops, fall of the acceleration becomes also smooth. In comparison with the case of slow acceleration, therefore, there can be obtained the effect that a soft feel of acceleration can be obtained though the acceleration operation is shorter than the case of slow acceleration.

As described above, this embodiment can accomplish rapid acceleration or smooth acceleration in accordance with the accelerator operation by the control of the throttle driving pattern. However, since the ordinary control system employs the construction wherein the supply fuel quantity $T_{inj}$ or the effective value $T_{adv}$ of the ignition timing is calculated on the basis of the measurement result of the air flow rate Q, the follow-up delay occurs if the change of the air flow rate Q is drastic and the drop or slow response of acceleration and the longitudinal vibration may occur directly. To solve these problems, the simultaneous control of the fuel quantity $T_{inj}$ supplied to the engine 11 and the ignition timing $T_{adv}$ is preferable to be executed in the following way.

Figure 5:
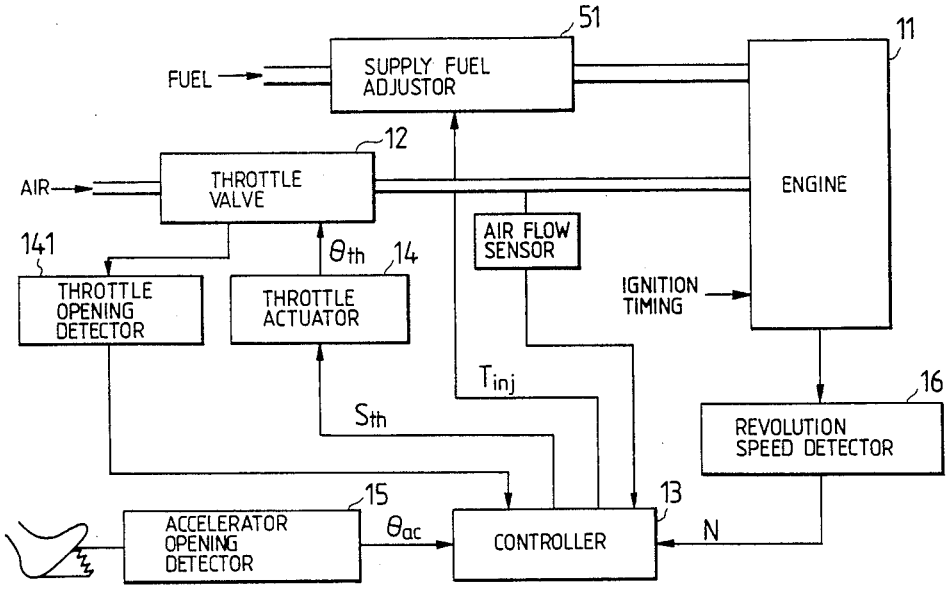
FIG. 5 is a structural block diagram showing another embodiment of the throttle control apparatus of an internal combustion engine in accordance with the present invention.

FIG. 5 is a structural block diagram of the simultaneous control of the supply fuel quantity in another embodiment of the throttle control apparatus of an internal combustion engine in accordance with the present invention. In FIG. 5, reference numeral 51 represents supply fuel regulation means. The drawing shows the structural example wherein the supply fuel regulation means 51 capable of suitably regulating the fuel quantity $T_{inj}$ to the engine 11 in accordance with the instruction of the control unit 13 is added to the construction of FIG. 1. In this construction, the control unit 13 determines the supply fuel quantity $T_{inj}$ as well as the throttle opening $\theta_{th}$ on the basis of the accelerator opening $\theta_{ac}$ and the rotating speed N in order to satisfy the requirement of the driver estimated from the accelerator operation, and the throttle driving signal $S_{th}$ to the throttle actuator 14 of the throttle valve 12 and the supply fuel quantity $T_{inj}$ to the supply fuel regulation means 51 are instructed, respectively. In accordance with this embodiment, therefore, the air-fuel ratio can be kept reliably at a desired value even under the transient state resulting from the abrupt change of the accelerator operation and the car body behaviour which is free from the car body vibration, and is quick in response and smooth can be accomplished with extremely high fuel efficiency.

Figure 6A:
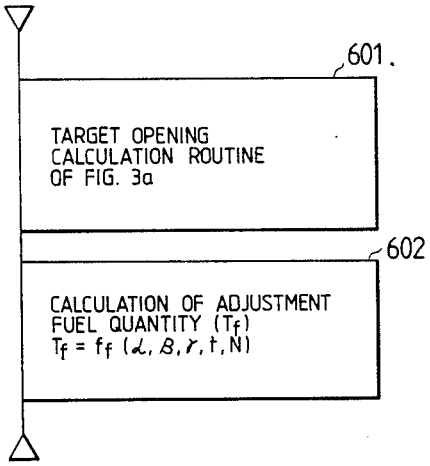
FIGS. 6*a* and 6*b* problem analysis diagrams showing the supply fuel quantity calculation algorithm of the controller of FIG. 5.
Figure 6B:
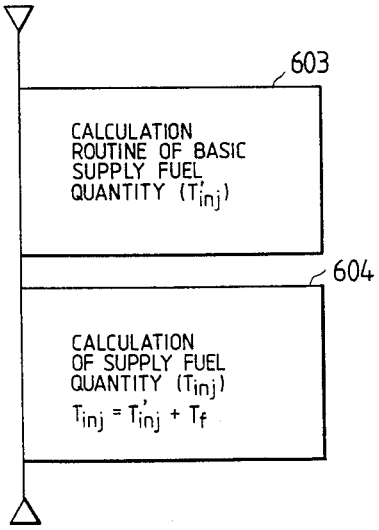

FIGS. 6*a* and 6*b* each are a problem analysis diagram showing an embodiment of the algorithm of the fuel supply quantity calculation of the fuel supply quantity simultaneous control in the control unit 13 shown in FIG. 5. FIG. 6*a* shows the task of the target opening calculation routine effected in every 20 msec, for example, shown in FIG. 3*a* (processing 601) and the task for adding the processing for calculating the regulation fuel quantity $T_f$ which must be regulated, as the throttle opening $\theta_{th}$ is controlled, so as to accomplish a desired air-fuel ratio, according to the target openings $\alpha$, $\beta$, $\gamma$ and the lapse time t from the rapid change of the accelerator operation and the revolution speed N, by the basic supply fuel quantity $T'_{inj}$ and the following function $f_f$ (processing 602): $T_f = f_f\ (\alpha,\beta,\gamma,t,N) = k_6.1/k_x\{1-\exp(-t(\text{msec})/k_7.N^{m6}\}.T'inj$ (7)

$k_x = \alpha, \beta$, or $\gamma$ $k_6$, $k_7$, $m_6$: constant

An example of the constants, $k_6$, $k_7$, $m_6$ are 0.8, 65, 0.1, respectively.

FIG. 6b shows the task for calculating the effective value $T_{inj}$ of the supply fuel quantity (processing 604) by adding the regulation fuel quantity $T_f$ described above to the basic fuel supply quantity $T'_{inj}$ (processing 603) by the existing basic fuel supply quantity $T'_{inj}$ calculation routine calculated for each cylinder unit or for each cylinder group unit in rotation synchronization, in accordance with the following equation:

$$T_{inj} = T'_{inj} + T_f \quad (8)$$

$T'_{inj}$ can be obtained from the equation fuel supply quantity/one cylinder = 120 G/SN, wherein G:air intake rate (g/s), s:the member of cylinder.

As described above, this embodiment provides the effect that the execution algorithm of the fuel supply quantity $T_{inj}$ control to be executed simultaneously with the throttle opening control can be realized simply in the form in which it is added to the calculation task of the throttle target opening or to the existing engine control logic.

Figure 7:
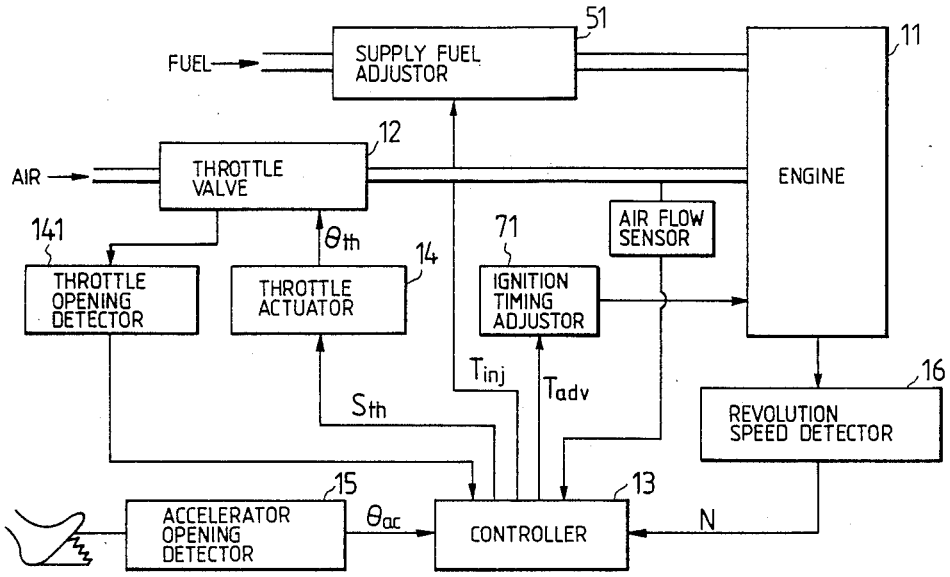
FIG. 7 is a structural block diagram showing still another embodiment of the throttle control apparatus of an internal combustion engine in accordance with the present invention.

FIG. 7 is a structural block diagram of the simultaneous control of the supply fuel quantity and the ignition timing in the throttle control apparatus of an internal combustion engine in still another embodiment of the present invention. In FIG. 7, reference numeral 71 represents ignition timing regulation means. The drawing shows the structural example wherein the supply fuel regulation means 51 in FIG. 5 and the ignition timing regulation means 71 capable of suitably regulating the ignition timing $T_{adv}$ in the engine 11 by the instruction of the control unit 13 are added to the throttle control apparatus shown in FIG. 1. In this construction, the control unit 13 determines the throttle opening $\theta_{th}$, the fuel supply quantity $T_{inj}$ and the ignition timing $T_{adv}$ on the basis of the accelerator opening $\theta_{ac}$ and the revolution speed N so as to satisfy the requirement of the driver estimated from the accelerator operation, and gives the instructions to the throttle actuator 14 of the throttle valve 12, the fuel supply regulation means 51 and the ignition timing regulation means 71. Therefore, in accordance with this embodiment, the air-fuel ratio can be kept at a desired value even under the transient state resulting from the rapid change of the accelerator operation and the optimum ignition timing can be set to this air-fuel ratio. Accordingly, this embodiment provides the effects that the car behaviour which is free from the car body vibration, is quick in response and is smooth can be accomplished with extremely high fuel efficiency.

Figure 8A:
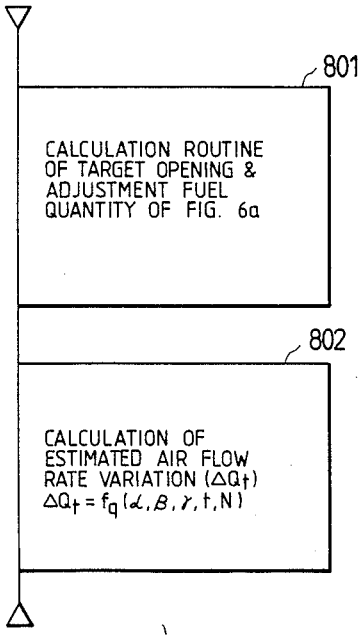
FIGS. 8*a* and 8*b* are problem analysis diagrams showing the ignition timing calculation algorithm of the controller shown in FIG. 7.
Figure 8B:
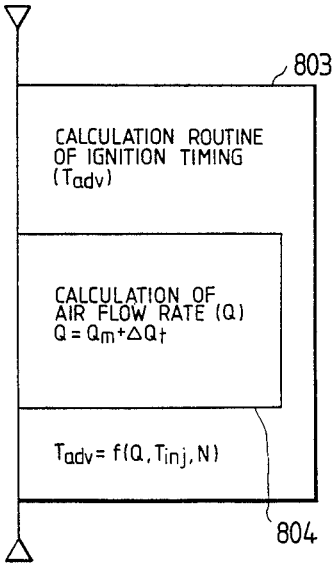

FIGS. 8a and 8b are problem analysis diagrams showing an embodiment of the ignition timing calculation algorithm of the ignition timing simultaneous control in the control unit 13 shown in FIG. 7. FIG. 8a shows the task (processing 802) for adding the calculation of anticipating the estimated air flow rate change content $\Delta Q_t$ changing due to the throttle opening control by the function $f_q$ of the following equation to the task (processing 801) of the target opening and regulation fuel quantity calculation routine of FIG. 6a:

$$\Delta Qt = f_q(\alpha, \beta, \gamma, t, N) = k_8 \cdot \frac{1}{k_x}\{1 - \exp(-t/k_9 \cdot N^{m7})\} \cdot Q_m \quad (9)$$

where $k_8$, $k_9$ and $m_7$ are constants, 2, 65 and 0.1 respectively, for example.

FIG. 8b shows the task (processing 804) of adding, to the inside of the existing ignition timing $T_{adv}$ calculation routine (processing 803) which is effected by the rotation synchronization, for example, calculating operation of the estimation value Q of the air flow rate by adding the estimated air flow rate change component $\Delta Q_t$ to the measured value $Q_m$ of the air flow rate by the following equation:

$$Q = Q_m + \Delta Q_t$$

The effective value $T_{adv}$ of the ignition timing is determined by means such as table retrieval by the function f of the following equation by use of this estimated value Q of this air flow rate (processing 803):

$$T_{adv} = f(Q, T_{inj}, N) \quad (10)$$

As described above, this embodiment can be accomplished easily in the form in which the execution algorithm of the fuel supply quantity and ignition timing control to be executed simultaneously with the throttle opening control is added to the calculation task of the throttle target opening control or to the existing engine control logic.

Figure 9:
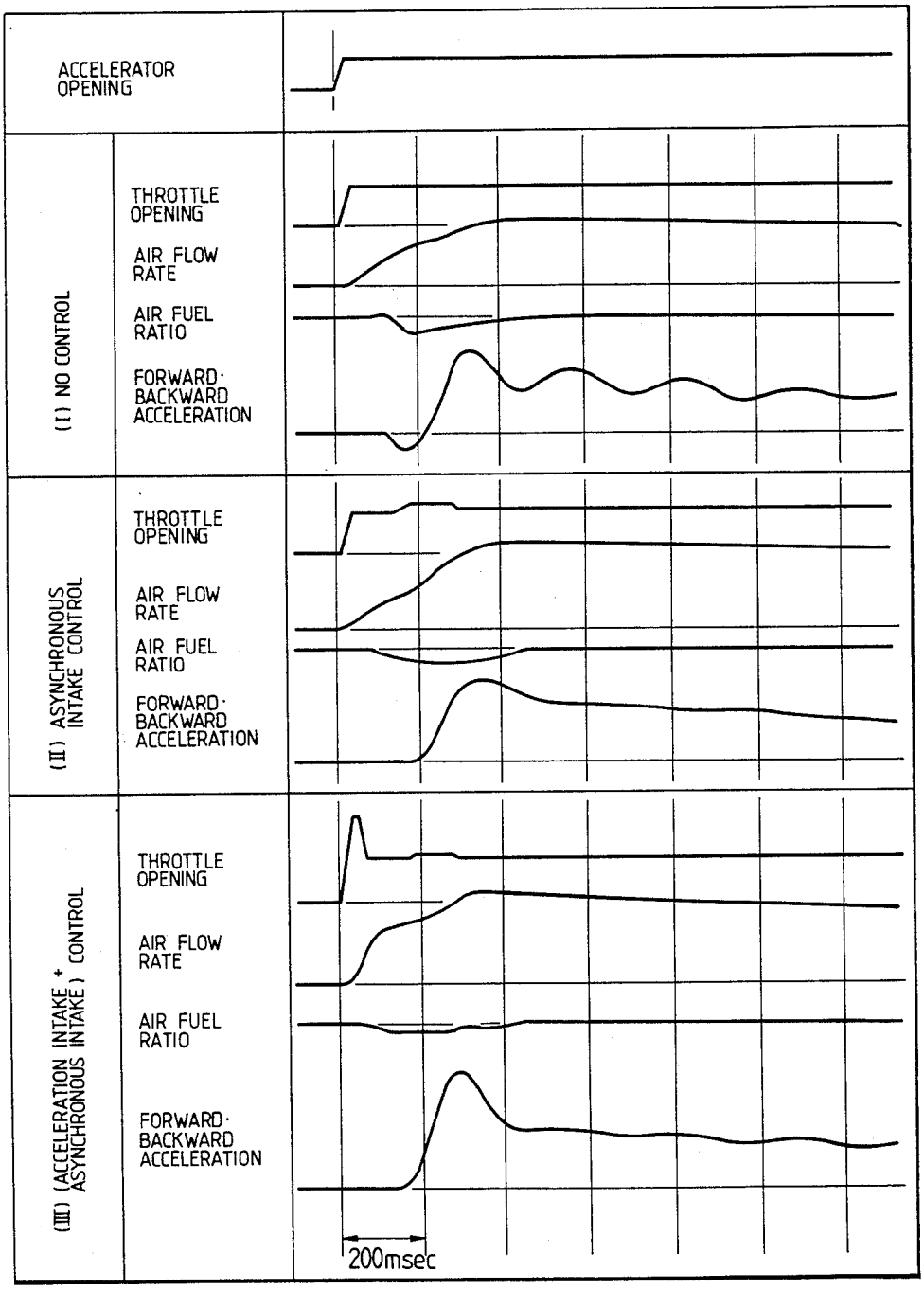
FIG. 9 is a chart diagram showing examples of experimental data in the cases of various controls of FIG. 7.

FIG. 9 is a chart diagram showing examples of the experimental data when the throttle opening control shown in FIG. 7 and the fuel supply quantity and ignition timing control are simultaneously executed. FIG. 9 shows three cases (I), (II) and (III) of control of the throttle opening with the rapid change of the accelerator opening, the changes of the air flow rate and air-fuel ratio on the basis of the former and the resulting acceleration in the longitudinal direction of the car body, respectively. First of all, in the case (I) where no control of the present invention is made, disturbance of the air-fuel ratio is so great that a remarkable drop in the longitudinal direction acceleration and longitudinal vibration occur. In contrast, in the case (II) where only the asynchronous intake control of the throttle opening is made after the fuel supply quantity and ignition timing controls are made simultaneously in accordance with the present invention, a clear increase due to the asynchronous intake can be observed in the air flow rate but there is no great disturbance in the air-fuel ratio and it shifts smoothly from the ordinary air-fuel ratio of 14.7 to a target air-fuel ratio of 12, for example, at the time of acceleration. Due to the effect of the ignition timing control, too, it is possible to observe clearly the effect that the drop of the longitudinal direction acceleration and the longitudinal vibration can be eliminated. Furthermore, in the case (III) where the acceleration intake of the throttle opening and the asynchronous intake control are executed conjointly after the simultaneous control of the supply fuel quantity and ignition timing control of the present invention is made, there can be observed the characterizing features in the rapid rise of the air flow rate and in the drastic increase in the air quantity due to the asynchronous intake. Though some disturbances occur in the air-fuel ratio due to these great changes and to the rapid increase in the rotating speed, neither drop in the longitudinal direction acceleration nor longitudinal vibration are observed and clear high speed response and high peak value can be confirmed. Thus, in accordance with this embodiment, high operability with quick response can be accomplished by the throttle opening control and preferably being accompanied with the simultaneous control of the supply fuel quantity and ignition timing.

In accordance with the present invention, it is possible to control suitably the air flow rate, the supply fuel quantity and the ignition timing in accordance with the accelerator operation speed. Accordingly, the drop and slow response of the acceleration and the longitudinal vibration that have occurred conventionally can be solved and at the same time, car body behaviour having high response can be accomplished. Furthermore, since the parameters of the engine control can be adjusted suitably in accordance with the accelerator operation speed, the driver can reflect his requirements more positively on the engine operation through the accelerator operation.

What is claimed is:

1. A throttle control apparatus of an internal combustion engine including an accelerator opening detector for detecting an accelerator depression, an engine revolution speed detector, a throttle actuating means for actuating a throttle valve and a control unit for outputting a driving signal for driving said throttle actuating means, wherein said control unit comprises a device for determining a throttle opening on the basis of an accelerator depression amount from said accelerator opening, an accelerator depression speed and the engine revolution speed from said engine revolution speed detector and for outputting a driving signal for the determined throttle opening to said throttle actuating means, wherein said driving signal outputted by said control unit actuates said throttle actuating means to rapidly operate said throttle valve upon a rapid change of an accelerator depression to a throttle opening more than that determined according to an accelerator depression quantity thereby to obtain desired longitudinal acceleration, and to open said throttle valve to a slightly larger opening than that determined according to the acceleration depression quantity after completion of the throttle operation for the desired longitudinal acceleration and after a certain time lapsed from the starting of the rapid change in the accelerator depression, whereby longitudinal vibration due to the desired acceleration is eliminated.

2. A throttle control apparatus of an internal combustion engine according to claim 1, which includes supply fuel quantity regulation means for estimating the air quantity supplied to the engine on the basis of the throttle opening determined by said control unit and for increasing or decreasing the supply fuel quantity providing a desired air-fuel ratio on the basis of the estimation value, in an interlocking arrangement with the opening/closing of said throttle valve.

3. A throttle control apparatus of an internal combustion engine according to claim 2, which includes ignition timing regulation means for regulating the ignition timing providing desired engine output efficiency for the air-fuel ratio calculated on the basis of the throttle opening determined by said control unit and the estimation value of the air quantity supplied to said engine, in an interlocking arrangement with the opening/closing of said throttle valve.

4. A throttle control apparatus of an internal combustion engine which is mounted on an automobile and provided with a throttle valve mounted on an air intake passage of the engine and an accelerator, said throttle control apparatus comprising an accelerator opening detector for detecting an accelerator depression, an engine revolution speed detector, a throttle actuating means for actuating the throttle valve, and a control unit for generating and outputting a driving signal for driving said actuating means thereby to control said throttle valve opening, wherein said control unit is constructed so as to generate and output to said throttle actuating means a throttle signal for opening the throttle valve for a time period to a throttle opening more than that determined according to an accelerator depression quantity after an accelerator operation at a speed more than a predetermined speed which is necessary for accelerating the automobile and may cause longitudinal vibration thereby, thereby to eliminate the longitudinal vibration.

5. A throttle control apparatus for internal combustion engine which is mounted on an automobile and provided with a throttle valve mounted on an air intake passage of the engine and an accelerator, said throttle control apparatus comprising an accelerator opening detector for detecting an accelerator depression quantity, an engine revolution speed detector, a throttle actuating means for actuating the throttle valve, and a control unit for generating and outputting a driving signal for driving said actuating means thereby to control said throttle valve opening, wherein said control unit is constructed so as to generate and output, to said throttle actuating means, a throttle driving signal for operating said throttle valve according to a throttle opening pattern determined on the basis of an accelerator opening, an accelerator opening speed and engine revolution speed; wherein said throttle opening pattern includes a first target opening to which the throttle valve is opened upon a rapid accelerator operation and which is determined according to an accelerator depression quantity, an accelerator depression speed and an engine revolution speed, a second target opening to which said throttle valve is opened after a predetermined time lapsed from the starting of the rapid accelerator depression and which is determined according to an accelerator depression quantity, an accelerator depression speed and an engine revolution speed, said predetermined time being determined on the basis of a surging period change rate and the accelerator depression speed.

6. A throttle control apparatus of an internal combustion engine for an automobile, including an accelerator opening detector for detecting an accelerator depression, an engine revolution speed detector, a throttle actuating means for actuating a throttle valve and a control unit for outputting a driving signal for driving said throttle actuating means, wherein said control unit comprises a device for generating and outputting to said throttle means, a throttle driving signal for operating said throttle valve according to a predetermined throttle opening pattern to eliminate longitudinal vibration of the automobile caused by a rapid change in load of the engine, said throttle opening pattern including a first target opening ($\alpha$) which is based on said rapid change in load, a second target opening ($\beta$) at a time ($\tau$) of asynchronous air intake caused asynchronously with accelerator operation to reduce vibration of longitudinal acceleration, and a third target opening ($\gamma$) for determining automobile speed at a time of settling of load change.

7. A throttle control apparatus according to claim 6, wherein said first target opening ($\alpha$) is determined as a function of accelerator depression amount, accelerator depression speed and engine speed.

8. A throttle control apparatus according to claim 7, wherein first target opening ($\alpha$) is determined from the relationship:

$$\alpha = k_1\left\{1 + k_2 \cdot \left|\frac{\theta ac}{A}\right|^{m_1} \cdot N^{m2}\right\}\theta ac$$

where $\theta$ac is accelerator depression amount, $\theta$ac is accelerator depression speed, N is engine speed, and $k_1$, $k_2$, $m_1$, $m_2$ and A are constants.

9. A throttle control apparatus according to claim 6, wherein said second target opening ($\beta$) occurs at a time ($\tau$) is determined from the relationship:

$$\tau = k_5 \cdot k_4 \cdot N^{m4} \cdot (\theta ac)^{m5}$$

where N is engine speed, $\theta$ac is accelerator depression speed and $k_4$, $k_5$, $m_4$ and $m_5$ are constants.

10. A throttle control apparatus according to claim 6, wherein said second target opening ($\beta$) is determined as a function of accelerator depression amount, accelerator depression speed and engine speed.

11. A throttle control apparatus according to claim 10, wherein said second target opening ($\beta$) is determined from the relationship:

$$\beta = k_1\left\{1 + k_3 \cdot \left|\frac{\theta ac}{B}\right|^{m_3} \cdot N^{m2}\right\}\theta ac$$

where $\theta$ac is accelerator depression amount, $\theta$ac is accelerator depression speed, N is engine speed, and $k_1$, $k_3$, $m_2$, $m_3$ and B are constants.

12. A throttle control apparatus according to claim 6, wherein said third target opening is a function of accelerator depression amount.

* * * * *